United States Patent [19]

Bjorkman, Jr.

[11] 4,256,554

[45] Mar. 17, 1981

[54] ELECTROLYTIC CELL FOR SEPARATING CHLORINE GAS FROM OTHER GASES

[75] Inventor: Harry K. Bjorkman, Jr., Birmingham, Mich.

[73] Assignee: Energy Development Associates, Inc., Madison Heights, Mich.

[21] Appl. No.: 134,929

[22] Filed: Mar. 28, 1980

[51] Int. Cl.[3] ..... C25B 1/26; C25B 9/00

[52] U.S. Cl. ..... 204/128; 204/258; 204/260; 204/265; 204/266

[58] Field of Search ..... 204/128, 130, 258, 260, 204/266, 278, 265

[56] References Cited

U.S. PATENT DOCUMENTS

| | | | |
|---|---|---|---|
| 3,813,301 | 5/1974 | Carr | 429/50 |
| 3,841,989 | 10/1974 | Delsa | 204/278 |
| 3,855,104 | 12/1974 | Messner | 204/258 |
| 3,891,532 | 6/1975 | Jensen | 204/260 |
| 3,909,298 | 9/1975 | Carr | 429/218 |
| 3,954,502 | 5/1976 | Symons | 429/39 |
| 4,177,116 | 12/1979 | Denora | 204/260 |
| 4,217,401 | 8/1980 | Pellegri | 204/266 |

*Primary Examiner*—T. M. Tufariello

*Attorney, Agent, or Firm*—Harness, Dickey & Pierce

[57] ABSTRACT

An electrolytic cell for separating chlorine gas from other (foreign) gases, having an anode electrode, a cathode electrode, a gas impermeable (but liquid permeable) membrane interposed between the anode and cathode electrodes, an aqueous electrolyte, a housing, and a constant voltage power supply. The electrolytic cell may be constructed in either a rectangular or cylindrical geometry, and may be combined with other electrolytic cells to form a multiple cell system. In operation, a stream of chlorine and foreign gases enters the cell at the lower portion of the cathode electrode. The chlorine gas is dissolved into the electrolytic and electrochemically reduced into chloride ions. The chloride ions diffuse through the gas impermeable membrane, and are electrochemically oxidized at the anode into purified chlorine gas. The foreign gases do not participate in the above, and are vented from the cell.

21 Claims, 6 Drawing Figures

ELECTROLYTIC CELL FOR SEPARATING CHLORINE GAS FROM OTHER GASES

BACKGROUND AND SUMMARY OF THE INVENTION

The present invention relates generally to electrolytic cells, and particularly cells where chlorine gas is reduced at the cathode electrode and chloride ions are oxidized at the anode electrode.

One application for such a cell, also referred to as chlorine-chlorine cell, is the separation of chlorine gas from a stream of chlorine and foreign gases. Such foreign gases could include, but are not limited to, carbon dioxide, oxygen and hydrogen gases. Although the chlorine-chlorine cell separation technique could be useful in the manufacture of chlorine gas, the principal application herein relates to zinc-halogen batteries such as a zinc chlorine battery. In the zinc-chlorine battery application, the foreign gases are also referred to as inert gases. This is because these gases are inert in the hydrate formation process whereby chlorine is stored in the battery. During the charging of a zinc-chlorine battery, chlorine gas is evolved at the positive electrode (anode) and zinc metal is deposited on the negative electrode (cathode). Thus, inside the battery casing, the environment is necessarily a chlorine gas environment. However, small quantities of other gases may also be present inside the battery case. For instance, carbon dioxide is evolved during normal operation of the battery as a by-product of the oxidation of the battery graphite. The volumetric rate of carbon dioxide evolution during battery charging is approximately 0.02% to 0.04% of the chlorine gas evolution rate. Consequently, if the carbon dioxide is not purged from the battery system, it will accumulate over a period of charge/discharge cycles, and eventually interfere with the normal operation of the battery. A brief discussion of a portion of the subject matter of the present application and the zinc-chlorine battery application may be found in: Development of the Zinc-Chlorine Battery for Utility Applications, Interim Report, April 1979, pages 36–9, 12, published by the Electric Power Research Institute, Palo Alto, Calif., and is herein incorporated by reference. A discussion of related electrolytic cells may also be found in a co-filed U.S. patent application entitled "Inert Gas Rejection Device For Zinc-Halogen Battery Systems," assigned to the assignee of the present invention, and is herein incorporated by reference.

The present invention provides a novel electrolytic cell for separating foreign gases from a stream of chlorine and foreign gases. Particularly, the electrolytic cell is generally comprised of a cathode electrode for electrochemically reducing chlorine gas into chloride ions, an anode electrode for oxidizing the chloride ions into chlorine gas, a membrane interposed between the anode and cathode electrodes for preventing the transfer of foreign gases to the anode electrode, a housing for aligning the membrane and electrodes in the cell, an aqueous electrolyte contained in the housing, and a power supply for providing a sufficient potential difference across the anode and cathode electrodes to cause the chlorine gas reduction and chloride ion oxidation reactions. The housing also includes a separate outlet on each side of the membrane to vent the foreign gases (cathode side) and chlorine gas (anode side) from the cell.

The present invention further provides for a novel multiple cell system for use when the gas flow rate into one cell is beyond its capacity to reduce all of the chlorine gas entering the cell. Generally, when the chlorine and foreign gas flow rate into a cell is very low, even an inefficient cell will be capable of reducing all or substantially all of the chlorine gas at the cathode. This is especially true if the applied voltage across the cell is relatively high (i.e. about two volts), as it will keep the cathode very cathodic. However, when the gas flow rate is increased significantly, even an efficient cell may not be capable of reducing all of the chlorine gas. This results in unreacted chlorine gas being vented from the cathode assembly along with the foreign gases. This result is unacceptable because it is desirable to vent the foreign gases into the atmosphere. Thus, with relatively high gas flow rates it is a practical necessity to have more than one cell in order to handle any overflow of unreacted chlorine gas from the cell. The subsequent cell would use as its input the outlet from the cathode section of the previous cell. Alternatively, a plurality of anodes and cathodes could be provided in a common housing, where the stream of chlorine and foreign gases would be divided among the number of cathodes to achieve an effective reduction of the gas flow rate in the multiple cell system.

Other features and advantages of the invention will become apparent in view of the drawings and the following detailed description of the preferred embodiments.

DESCRIPTION OF THE PREFERRED EMBODIMENTS

Figure 1:
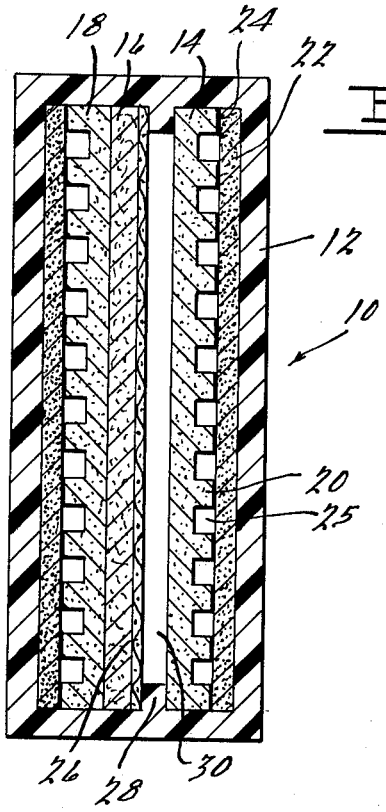
FIG. 1 is a cross-sectional top elevation view of an electrolytic cell according to the present invention.

Referring to FIG. 1, a top elevation view of an electrolytic cell 10 according to the present invention is shown. The cell is generally comprised of a housing 12, a cathode electrode 14, a membrane 16, an anode electrode 18, and an aqueous electrolyte filled to the top of the electrodes. Both the cathode and anode electrodes are constructed from porous graphite (liquid permeable but gas impermeable), preferably Union Carbide Corp. PG-60 graphite or Airco Speer 37-G graphite. However, the cathode and anode electrodes may also be constructed from any suitable electrically conductive material which is chemically resistent or inert to the electrolyte and other chemical entities with which it will come into contact. Thus, these electrodes also may be constructed from ruthenized titanium. In the surface of the cathode electrode facing the outside of the cell a plurality of ridges 20 are formed. These ridges are secured to a wall 22 with a conductive cement 24 to form vertical passageways 25 along the height of the electrode. Wall 22 is constructed from dense or fine grained graphite (liquid and gas impermeable), preferably Union Carbide Corp. CS grade graphite. The cement is an electrically conductive resinous polymeric cement, such as Cotronics Corp. 931 graphite adhesive or a composition of graphite and furfuryl alcohol. As illustrated in FIG. 1, a similar construction for the formation of passageways is provided for anode electrode 18. A more detailed description of the electrode and passageways may be found in U.S. Pat. No. 3,954,502 issued May 4, 1976, entitled "Bipolar Electrode For Cell Of High Energy Density Secondary Battery," and is herein incorporated by reference.

Interposed between cathode electrode 14 and anode electrode 18 is membrane 16. The membrane may be made from any suitable material which will permit the transfer of ions and liquid and prevent the transfer of gas across it, and be chemically resistent or inert to the electrolyte and other chemical entities with which it will come into contact. Thus, the membrane may be constructed from asbestos, ceramics, Dupont Nafion, or porous graphite. In the electrolytic cell of FIG. 1, an asbestos membrane is employed. This membrane is held in place by a titanium mesh screen 26, and the screen is in turn held in place by a spacer member 28 on each side of the cell. It should be appreciated that if another material is used for the membrane in substitution for the asbestos, such as porous graphite, the titanium mesh screen is not necessary and may be deleted. With such a substitution, the spacers also provide an electrical isolation between the cathode and anode electrodes in the cell, as exemplified by cell gap 30. The spacers are preferably constructed from the same material as housing 12, and may be an integral part thereof. The housing may be made from any suitable electrically non-conductive material, which is chemically resistent or inert to the electrolyte and other chemical entities with which it will come into contact. Thus, the housing may be constructed from such materials as General Tire & Rubber Corp. Boltron polyvinyl chloride (4008-2124), Dupont Teflon (tetrafluorinated ethylene), Pennwalt Kynar (polyvinylidene fluoride), or any of the other appropriate materials described in Section 33 of the Development of the Zinc-Chlorine Battery for Utility Applications report identified earlier.

The electrolyte for this cell (as well as for the subsequent embodiments) is preferably composed of a 10% by weight solution by hydrochloric acid in water. However, the hydrochloric acid concentration may be varied over a range from 5% to 30% without an appreciable affect on the performance of the cell. Alternate chloride ion containing electrolytes may also be provided, such as zinc chloride, potassium chloride or sodium chloride.

In operation, the stream of chlorine and foreign gases enters cell 10 at the bottom of passageways 25. The chlorine gas dissolves into the electrolyte and diffuses through cathode electrode 14, where it is electrochemically reduced into chloride ions. However, as the foreign gases do not dissolve into the electrolyte or participate in any electrochemical reactions, they will rise up the passageways and be vented into cell gap 30 through holes (not shown) drilled in the cathode electrode at the top of the passageways. Any unreacted and undissolved chlorine gas will also be vented along with the foreign gases. As membrane 16 is gas impermeable, the foreign and chlorine gases are prevented from reaching anode electrode 18, and are vented from the cell through an appropriate aperture in the top of the housing. The chloride ions in the cell gap 30 diffuse through membrane 16, and are electrochemically oxidized at anode electrode 18 to form chlorine gas. Although in practice a portion of the chlorine gas was generated in the passageways of the anode electrode, most of the chlorine gas was generated at the surface of the anode electrode facing the membrane. As a result, the chlorine gas generated at this interface was forced to push the membrane aside in order to rise up the electrode and be vented out of the cell. Although this result was undesirable, this cell successfully demonstrated the concept of separating foreign gases from a stream of chlorine and foreign gases through the use of an electrolytic cell.

In order for the reduction of chlorine gas and oxidation of chloride ions to take place, a sufficient potential difference must be provided between the cathode and anode electrodes. Such potential difference may be in the range of 0.2 to 2.0 volts. Any suitable direct current (constant voltage) power supply may be used which will provide an appropriate current density over the active surface area of the cell in the above-identified voltage range. Such a power supply should be capable of providing a current density up to 300 milli-amperes per square centi-meter of active (apparent) surface area.

Figure 2:
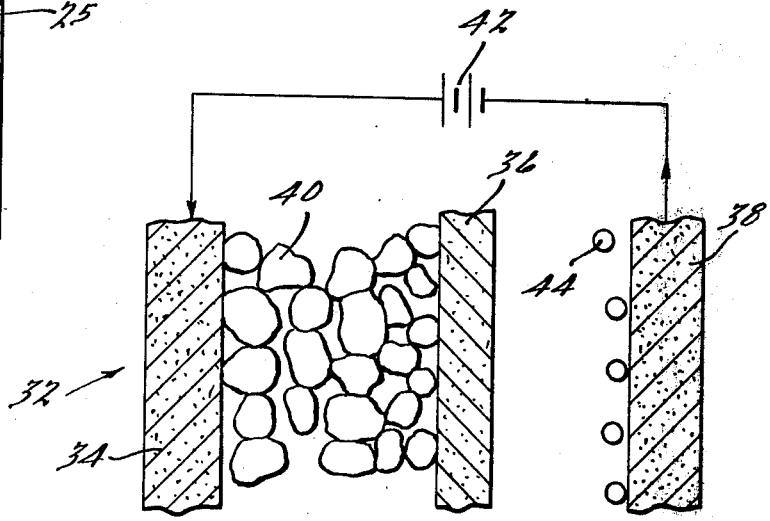
FIG. 2 is a sectional side elevation view of an electrolytic cell utilizing a packed bed between the cathode electrode and the membrane.

Referring to FIG. 2, a sectional side elevation view of an electrolytic cell 52 illustrating the concept of a cathode assembly if shown. The cathode assembly is generally comprised of a cathode electrode 34, a membrane 36, and a packed bed of graphite particles 40 interposed between the cathode electrode and the membrane. Both the cathode electrode 34 and the anode electrode 38 are constructed from dense or fined grained graphite. The graphite particles (or powder) provide the primary sites for the reduction of chlorine gas, and provide a substantial increase in the available surface area for the chlorine gas reduction to take place. The graphite powder is made from activated Union Carbide Corp. PG-60 graphite. A description of the preferred process for activating graphite may be found in U.S. Pat. No. 4,120,774, issued Oct. 17, 1978, entitled "Reduction of Electrode Overvoltage," and is herein incorporated by reference. However, it should be understood that other electrically conductive, electrochemically active, and chemically resistive or inert materials may be employed as a substitute for the graphite powder, such as particles of carbon or ruthenized titanium.

Also shown in FIG. 2 is a schematic representation of a source of direct current electrical powder, and direction of the current flow as indicated by the arrows. Finally, for illustrative purposes gas bubbles 44 are shown, and represent the chlorine gas generated at the anode electrode.

Figure 3:
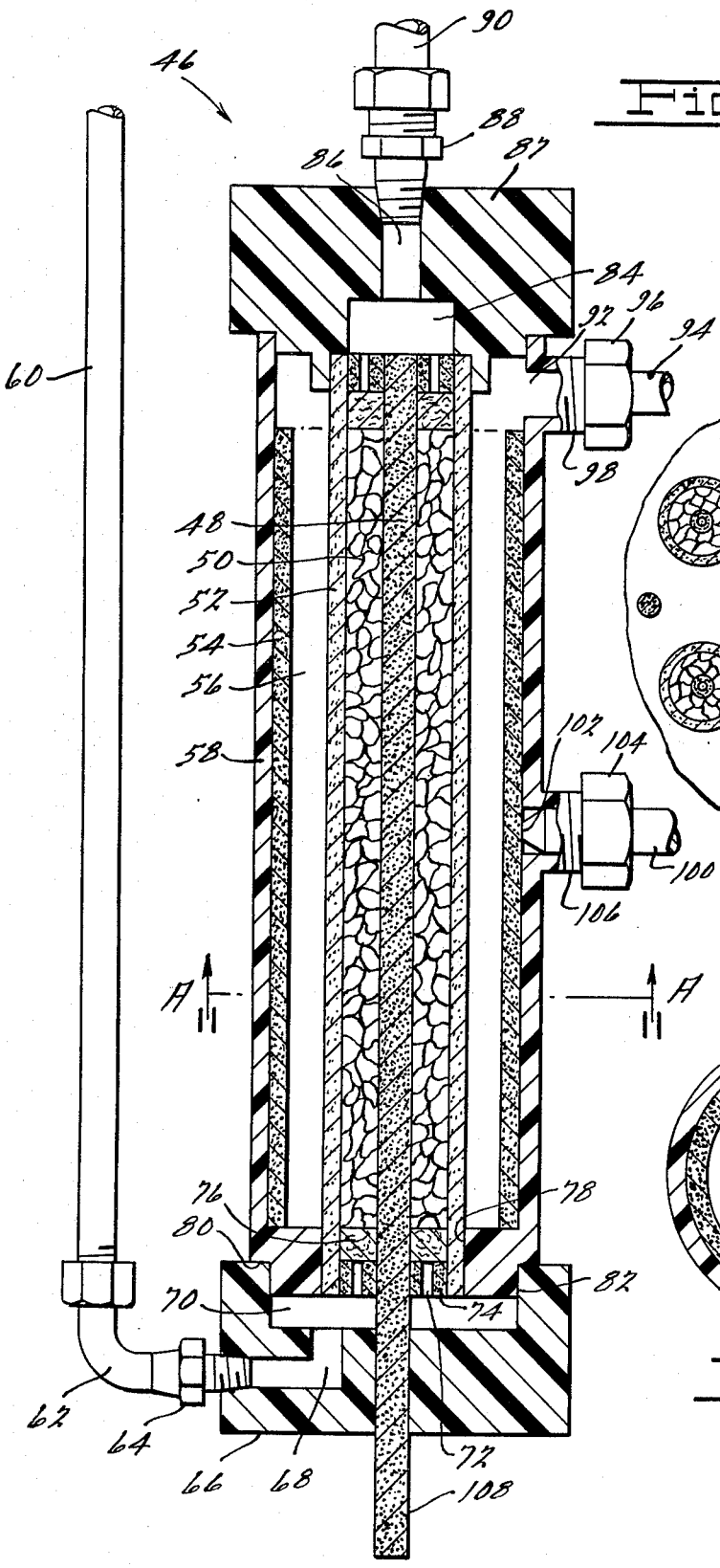
FIG. 3 is a sectional side elevation view of a cylindrical electrolytic cell according to the present invention.
Figure 4:
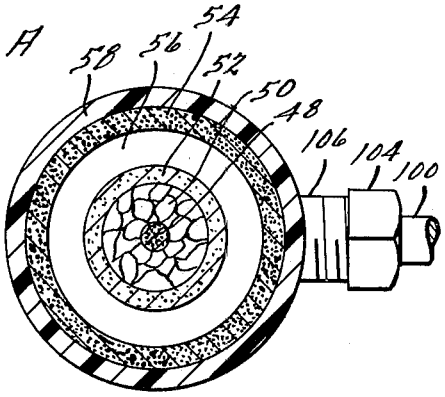
FIG. 4 is a cross-sectional view along lines AA of the electrolytic cell in FIG. 3.

Referring to FIG. 3, a sectional side elevation view of a cylindrical cell 46 according to the present invention is shown. This cell represents the embodiment of the cathode assembly concept illustrated in FIG. 2. Cell 46 is generally comprised of a cathode electrode rod 48, a packing of graphite particles 50, a membrane cylinder 52, an anode electrode cylinder 54 suitably larger in diameter than the membrane to provide for cell gap 56, and a housing 58. A cross-sectional view of this cell is also shown in FIG. 4, which is taken along lines AA of FIG. 3. In this embodiment, the cathode electrode rod and anode electrode cylinder are constructed from dense or fine grained graphite, the membrane is constructed from porous graphite and the housing is constructed from Boltron polyvinyl chloride.

The stream of chlorine and foreign gases is injected into the cell through tube 60, which is preferably constructed from Teflon. The gases travel through tube 60, elbow 62, connector 64, and enter the cell through passageways 68 and 70 provided in the bottom cap 66 of the housing. The gases then travel through the plurality of holes 72 in the dense graphite plug 74, diffuse through a layer of Carborundum Co. graphite felt 76, and enter the packed bed of graphite particles 50. It should be appreciated that a gas-tight seal is achieved at the bottom of membrane 52 in order to prevent the foreign gases from entering cell gap 56. This seal is achieved by a press fit between plug 74 and one face of membrane 52, and a press fit between the other face of the membrane and surface 78 of the housing. Surface 78 may additionally be supplied with a coating of a Kynar adhesive (75% NN-dimethyl formamide) in order to cement the housing to the membrane. This Kynar adhesive may also be used to seal bottom cap 66 to the housing at surfaces 80 and 82, or in addition or as a substitution, plastic welding techniques may be used as well. It should be observed that a similar plug, felt, and sealing construction is also employed at the top of the cell.

The foreign gases and any unreacted chlorine gas is vented from the top of the cathode assembly into passageways 84 and 86 in the top cap 87 of the housing. These gases are then vented from the cell through connector 88 and tube 90. As with tube 60, tube 90 is also preferably made from Teflon. Connectors 64 and 88, as well as elbow 62, are preferably made from Kynar.

The chlorine gas generated at anode electrode 54 rises up into the gas space 92 above the electrolyte type (at the top of the anode electrode), and is vented out of the cell through tube 94. Tube 94 is preferably made from Teflon, and is secured to the housing by a Kynar threaded cap 96 over housing portion 98. A similar construction is also employed to provide an electrical connection from the power supply to the anode electrode. A dense graphite rod 100 is inserted into the housing, and is pressed up against surface 102 of the anode electrode to provide this electrical connection. Rod 100 is secured to the housing by threaded cap 104 over housing portion 106. The electrical connection for the cathode electrode may be made by conventional means anywhere along portion 108 of the cathode electrode rod.

Figure 5:
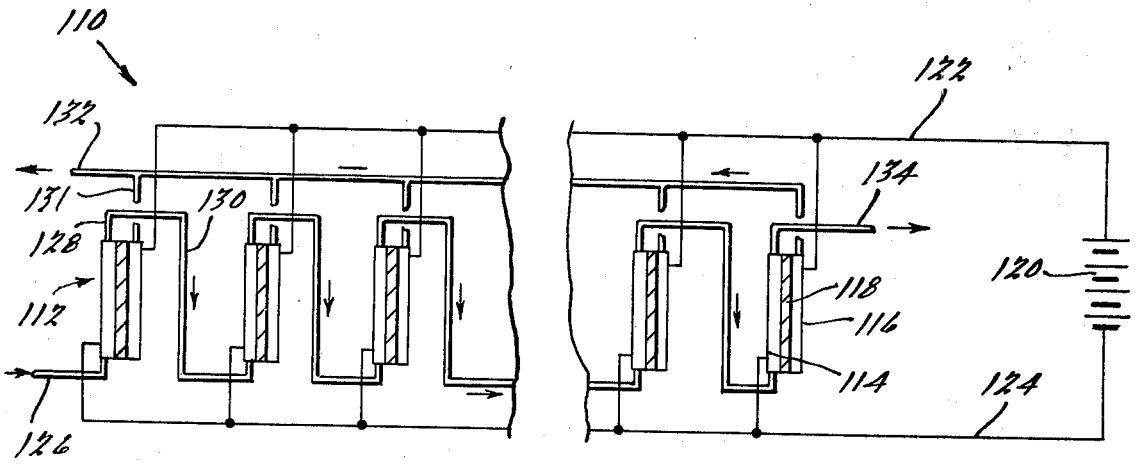
FIG. 5 is a schematic view of a multiple cell arrangement according to the present invention.

Referring to FIG. 5, a schematic view of a multiple cell arrangement 110 according to the present invention is shown. The plurality of electrolytic cells 112 each have a cathode section 114, a membrane 118, and an anode section 116. For example, these cells could each represent a cell such as electrolytic cell 46 illustrated in FIGS. 3 and 4. A single power supply 120 provides the electrical power for the cell arrangement. These cells are connected in parallel, with conductor 122 connected to each of the anode electrodes in the cells, and conductor 124 connected to each of the cathode electrodes in the cells. The stream of chlorine and foreign gases enters the cathode section of the first cell through tube 126. The foreign gases and unreacted chlorine gas leave the first cell through outlet tube 128, and pass through tube 130 which provides the inlet to the cathode section of the next cell. This interconnection of the outlet tube from the cathode section of a previous cell to the inlet tube of the cathode section of the subsequent cell is repeated as necessary to insure a complete separation of the foreign gases from the chlorine gas. It should be appreciated that the number of cells needed is dependent from the flow rate of the gases and the efficiency of the cells. The chlorine gas generated at the anode electrode in the first cell is vented through outlet tube 131 and into tube 132, which collects the chlorine gas generated in each of the cells. Finally, tube 134 from the cathode section of the last cell provides the outlet for the foreign gases from the cell arrangement (which may be simply vented into the atmosphere).

Figure 6:
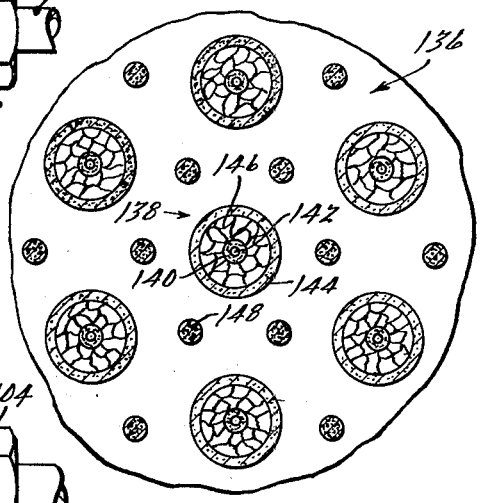
FIG. 6 is a cross-sectional view of an alternate embodiment of a multiple cell arrangement according to the present invention.

Referring to FIG. 6, a cross-sectional view of an alternate embodiment of a multiple cell arrangement 136 according to the present invention is shown. In this cell design, a plurality of cathode assemblies 138 and anode electrodes 148 would be contained in a common housing (not shown). As in the cell design of FIG. 3, the cathode assembly employs a dense graphite cathode electrode rod 140, a porous graphite membrane cylinder 144, and a packing of graphite particles 146. However, an alternate means for injecting the stream of chlorine and foreign gases into the cathode assembly is illustrated. By providing a hole 142 through the length of the cathode electrode rod (and a cross hole in the rod at the bottom of the graphite packing), the gases could be injected down through the center of the cathode assembly. It should be appreciated that a Teflon tube could be used in the place of the cathode electrode rod. In such a case, at least one of the dense graphite plugs sealing the top and bottom of the cathode assembly (corresponding to plug 74 of FIG. 3) would be incorporated into a dense graphite bus structure connecting each of the cathode assemblies in the cell arrangement. In either case, a dense graphite bus structure would also be provided to connect each of the anode electrode rods 148. Thus, these bus structures would provide an electrically parallel connection for the respective cathode assemblies and anode electrodes in the cell arrangement. It should also be appreciated that the cell arrangement in FIG. 6 would not employ the successive passes of the foreign and unreacted chlorine gases from one cell to another, as in the cell arrangement of FIG. 5. Rather, the stream of chlorine and foreign gases entering the cell arrangement would be divided among the plurality of cathode assemblies 138. Thus, a complete separation of the foreign gases from the chlorine gas would be achieved by dividing the flow rate of the stream of gases among the number of cathode assemblies in the cell arrangement.

It will be appreciated by those skilled in the art that various changes and modifications may be made to the electrolytic cells and multiple cell arrangements described in this specification without departing from the spirit and scope of the invention as defined by the appended claims. The various embodiments which have been set forth were for the purpose of illustration and were not intended to limit the invention.

What is claimed is:

1. An electrolytic cell for separating foreign gases from a stream of chlorine and foreign gases, comprising:

(a) cathode means for reducing chlorine gas into chloride ions;

(b) anode means for oxidizing chloride ions into chlorine gas;

(c) membrane means for permitting ionic and liquid transfer and preventing gas transfer between said cathode and anode means;

(d) a housing for aligning said cathode means, said membrane means, and said anode means, and including inlet means for receiving said stream of chlorine and foreign gases, foreign gas outlet means for venting said foreign gases from said cell, and chlorine gas outlet means for venting said chlorine gas generated by said anode means from said cell;

(e) an aqueous electrolyte contained in said housing; and (f) electrical power means for providing a potential difference across said anode and cathode means sufficient to cause said chlorine gas reduction and chloride ion oxidation.

2. The electrolytic cell according to claim 1, wherein said cathode means includes a cathode electrode, and said anode means includes an anode electrode.

3. The electrolytic cell according to claim 2, wherein said cathode means further includes a packing of carbonaceous particles interposed between said cathode electrode and said membrane means.

4. The electrolytic cell according to claim 3, wherein said carbonaceous particles are composed of graphite.

5. The electrolytic cell according to claim 2, wherein said cathode and anode electrodes are constructed from porous graphite.

6. The electrolytic cell according to claim 2, wherein at least one of said cathode and anode electrodes is constructed from dense graphite.

7. The electrolytic cell according to claim 2, wherein at least one of said cathode and anode electrodes is constructed from ruthenized titanium.

8. The electrolytic cell according to claim 2, wherein said inlet means is in association with the lower end of said cathode electrode.

9. The electrolytic cell according to claim 2, wherein said foreign gas outlet means is in association with the top end of said cathode electrode.

10. The electrolytic cell according to claim 2, wherein said foreign gas outlet means is disposed in the top of said housing between said cathode electrode and said membrane means.

11. The electrolytic cell according to claim 2, wherein said chlorine gas outlet means is in association with the top end of said anode electrode.

12. The electrolytic cell according to claim 2, wherein said chlorine gas outlet means is disposed in the top of said housing between said anode electrode and said membrane means.

13. The electrolytic cell according to claim 1, wherein said housing is constructed from an electrically non-conductive material chemically resistent to said chlorine gas and said electrolyte.

14. The electrolytic cell according to claim 1, wherein said electrolyte is composed at least in part of a chloride ion containing species.

15. The electrolytic cell according to claim 1, wherein said electrolyte is composed of dilute hydrochloric acid.

16. The electrolytic cell according to claim 15, wherein said concentration of hydrochloric acid is between 5 and 15 percent by weight of electrolyte.

17. The electrolytic cell according to claim 1, wherein said cell is in association with a zinc-chlorine battery for removing foreign gases from said battery.

18. A cylindrical electrolytic cell for separating foreign gases from a stream of chlorine and foreign gases, comprising:

(a) cathode assembly means for reducing chlorine gas into chloride ions, include a central cathode electrode rod, membrane cylinder means for permitting the transfer of said chloride ions from said cathode assembly, and a packing of graphite particles interposed between said cathode electrode rod and said membrane cylinder means;

(b) an outer anode electrode cylinder, spaced apart from said cathode assembly means, for oxidizing said chloride ions into chlorine gas;

(c) a housing for aligning and separating said cathode assembly means and said anode electrode cylinder, includng inlet means for receiving said stream of chlorine and foreign gases, foreign gas outlet means for venting said foreign gases from said cell, and chlorine gas outlet means for venting said chlorine gas generated at said anode electrode from said cell;

(d) an aqueous electrolyte contained in said housing; and (e) electrical power means for providing a potential difference across said anode and cathode electrodes sufficient to cause said chlorine gas reduction and chloride ion oxidation.

19. A multiple cell system for separating foreign gases from a stream of chlorine and foreign gases, comprising:

(a) a plurality of electrolytic cells each having cathode means for reducing chlorine gas into chloride ions, anode means for oxidizing chloride ions into chlorine gas, membrane means for permitting ionic and liquid transfer and preventing gas transfer between said cathode and anode means, a housing, and an aqueous electrolyte contained in said housing;

(b) first gas passage means for connecting the outlet of said cathode means from a previous electrolytic cell with the inlet of said cathode means for a subsequent electrolytic cell;

(c) second gas passage means for interconnecting the outlets of said anode means for each of said electrolytic cells; and (d) electrical power means for providing a potential difference across said anode and cathode means sufficient to cause said chlorine gas reduction and chloride ion oxidation for each of said electrolytic cells.

20. A multiple cell system for separating foreign gases from a stream of chlorine and foreign gases, comprising:

(a) a plurality of cathode assembly means for reducing chlorine gas into chloride ions, including a packing of graphite particles contained in a membrane means for permitting chloride ion transfer from said cathode assembly means;

(b) a plurality of anode means, spaced generally equidistant around each of said cathode assembly means, for oxidizing said chloride ions into chlorine gas;

(c) first electrically conductive bus means for interconnecting at least one end of each of said cathode assembly means;

(d) second electrically conductive bus means for interconnecting at least one end of each of said anode means;

(e) a housing for aligning and separating said pluraity of cathode assembly means and said anode means, including inlet means for receiving said stream of chlorine and foreign gases, distribution means for dividing said stream of chlorine and foreign gases among said cathode assembly means; foreign gas outlet means for venting said foreign gases from said cell, and chlorine gas outlet means for venting said chlorine gas generated by said plurality of anode means from said cell;

(f) an aqueous electrolyte contained in said housing; and (g) electrical power means, connected across said first and second bus means, for providing a potential difference sufficient to cause said chlorine gas reduction and said chloride ion oxidation.

21. A method of separating foreign gases from a stream of chlorine and foreign gases in an electrolytic cell having a housing, a cathode electrode, an anode electrode, membrane means for permitting only ionic and liquid transfer between said cathode and anode electrodes, an aqueous electrolyte, and electrical power means for providing a potential difference across said cathode and anode electrodes, comprising the steps of:

(a) injecting said stream of chlorine and foreign gases into said cell, so that said stream comes into contact with said cathode electrode;

(b) dissolving said chlorine gas into said electrolyte;

(c) reducing said chlorine gas into chloride ions at said cathode electrode;

(d) transferring said chloride ions through said membrane means to said anode electrode;

(e) oxidizing said chloride ions into chlorine gas at said anode electrode, concomitantly with said chlorine gas reduction;

(f) venting said chlorine gas generated at said anode electrode from said housing; and (g) venting said foreign gases from said housing above said cathode electrode.

* * * * *

UNITED STATES PATENT AND TRADEMARK OFFICE

CERTIFICATE OF CORRECTION

PATENT NO. : 4,256,554

DATED : March 17, 1981

INVENTOR(S) : Bjorkman, Harry K.

It is certified that error appears in the above—identified patent and that said Letters Patent is hereby corrected as shown below:

In Abstract, line 12, "electrolytic" should be --electrolyte--

Column 5, line 32, "type" should be --level--

Column 6, line 1, "from" should be --upon--

Column 8, line 9, "includng" should be --including--

Column 8, line 61, "pluraity" should be --plurality--

Signed and Sealed this

*Twenty-fourth* Day of *November 1981*

[SEAL]

*Attest:*

GERALD J. MOSSINGHOFF

*Attesting Officer*

*Commissioner of Patents and Trademarks*